US009142076B2

(12) United States Patent
Lee

(10) Patent No.: US 9,142,076 B2
(45) Date of Patent: Sep. 22, 2015

(54) MEDIA CASE AND BANKING MACHINE

(75) Inventor: Sung-Woo Lee, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/238,070

(22) PCT Filed: Aug. 8, 2012

(86) PCT No.: PCT/KR2012/006322

§ 371 (c)(1),
(2), (4) Date: May 21, 2014

(87) PCT Pub. No.: WO2013/022275

PCT Pub. Date: Feb. 14, 2013

(65) Prior Publication Data

US 2014/0284171 A1 Sep. 25, 2014

(30) Foreign Application Priority Data

Aug. 8, 2011 (KR) ..... 10-2011-0078431
Aug. 9, 2011 (KR) ..... 10-2011-0078844
Nov. 10, 2011 (KR) ..... 10-2011-0117039

(51) Int. Cl.
*G07D 11/00* (2006.01)
*G07F 19/00* (2006.01)

(52) U.S. Cl.
CPC ..... *G07D 11/0012* (2013.01); *G07D 11/0081* (2013.01); *G07F 19/202* (2013.01); *G07F 19/203* (2013.01)

(58) Field of Classification Search
CPC ..... G07D 11/0012; G07D 13/00; G07D 2211/00; G07F 19/202; G07F 19/203
USPC ..... 194/206, 344, 346, 350; 209/534; 235/379
See application file for complete search history.

(56) References Cited

U.S. PATENT DOCUMENTS 4,795,889 A * 1/1989 Matuura et al. ..... 235/379
8,162,125 B1 * 4/2012 Csulits et al. ..... 194/206

FOREIGN PATENT DOCUMENTS

JP 2003-141367 A 5/2003
JP 2006-107006 A 4/2006
JP 2009-258885 A 11/2009
KR 20-0393559 Y1 8/2005
KR 10-2006-0081761 A 7/2006
KR 10-0618552 B1 8/2006
KR 10-2007-0047025 A 5/2007

(Continued)

OTHER PUBLICATIONS

International Search Report in International Application No. PCT/KR2012/006322, filed Aug. 8, 2012.
Notice of Allowance dated Dec. 31, 2012 in Korean Application No. 10-2011-0078431.

(Continued)

*Primary Examiner* — Mark Beauchaine
(74) *Attorney, Agent, or Firm* — Saliwanchik, Lloyd & Eisenschenk

(57) ABSTRACT

The present invention relates to a medium storage box. The medium storage box according to one aspect comprises: a medium depositing and withdrawing unit through which medium is deposited or withdrawn; a temporary medium stacker for temporarily stacking the medium deposited through the medium depositing and withdrawing unit; a medium storage unit for storing medium for withdrawal; a printing apparatus for printing one of the deposited medium and the medium for withdrawal; and a reversal unit for reversing the deposited medium when it is necessary to reverse the deposited medium.

26 Claims, 13 Drawing Sheets

(56) References Cited

FOREIGN PATENT DOCUMENTS

| | | | |
|---|---|---|---|
| KR | 10-2007-0079635 | | 8/2007 |
| KR | 10-2008-0047855 | A | 5/2008 |
| KR | 10-2008-0052379 | A | 6/2008 |
| KR | 10-2011-0090097 | A | 8/2011 |
| KR | 10-1082662 | B1 | 9/2011 |

OTHER PUBLICATIONS

Notice of Allowance dated Jun. 21, 2013 in Korean Application No. 10-2011-0117039.
Office Action dated Jan. 6, 2015 in Japanese Application No. 2014-524930, (3 pages).

* cited by examiner

MEDIA CASE AND BANKING MACHINE

CROSS-REFERENCE TO RELATED APPLICATIONS

This application is the U.S. national stage application of International Patent Application No. PCT/KR2012/006322, filed Aug. 8, 2012, which claims priority to Korean Application Nos. 10-2011-0078431, filed Aug. 8, 2011; 10-2011-0078844, filed Aug. 9, 2011; and 10-2011-0117039, filed Nov. 10, 2011, the disclosures of each of which are incorporated herein by reference in their entirety.

TECHNICAL FIELD

The present invention relates to a medium storage box and a financial device.

BACKGROUND ART

Generally, financial devices process financial tasks that customers demand. Financial devices may allow medium to be deposited or withdrawn or automatically transfer medium. For example, financial devices may allow banknotes or checks to be deposited or withdrawn.

However, general financial devices are configured to allow banknotes or checks to be deposited or withdrawn through separate depositing and withdrawing units. That is, financial devices comprise a banknote depositing and withdrawing unit, a banknotes transfer path, and a banknote processing module together with a check depositing and withdrawing unit, check transfer path, and a check processing module.

In general financial devices, since banknotes and checks are separately processed, a structure thereof is complicated and time for processing tasks increases.

Particularly, since general financial devices are configured to allow checks to be deposed one by one, a considerable time is consumed for depositing checks.

DISCLOSURE OF THE INVENTION

Technical Problem

Embodiments provide a financial device capable of allowing banknotes and checks to be deposited or withdrawn through a single depositing and withdrawing unit.

Embodiments also provide a medium storage box and a financial device, capable of allowing checks to be processed regardless of a direction of depositing the checks.

Technical Solution

In one embodiment, a medium storage box comprises a medium depositing and withdrawing unit through which medium is deposited or withdrawn, a temporary medium stacker for temporarily stacking the medium deposited through the medium depositing and withdrawing unit, a medium storage unit for storing medium for withdrawal, a printing apparatus for printing one of the deposited medium and the medium for withdrawal, and a reversal unit for reversing the deposited medium when it is necessary to reverse the deposited medium.

The medium storage box may further comprise a deposit path formed to be connected from the medium depositing and withdrawing unit to the temporary medium stacker while detouring the printing apparatus and a withdrawal path formed to be connected from the temporary medium stacker to the medium depositing and withdrawing unit while passing through the printing apparatus.

The medium deposited through the medium depositing and withdrawing unit may be transferred along the deposit path and stacked in the temporary medium stacker, and the medium stacked in the temporary medium stacker may be transferred along the withdrawal path and printed by the printing apparatus.

The medium for withdrawal stored in the medium storage unit may be transferred along the deposit path and printed by the printing apparatus.

The medium storage box may further comprise an depositing and withdrawing path connecting the deposit path and the withdrawal path to the medium depositing and withdrawing unit and a diverter for adjusting a transfer direction of medium to allow the medium on the depositing and withdrawing path to be transferred to the deposit path.

The reversal unit may be disposed on a path between the printing apparatus and the temporary medium stacker.

When it is necessary to reverse the deposited medium, the deposited medium may be reversed by the reversal unit and then stacked in the temporary medium stacker.

The deposited medium may be stacked in the temporary medium stacker without reversal, and when it is necessary to reverse the deposited medium, the medium stacked in the temporary medium stacker may be reversed by the reversal unit and printed by the printing apparatus.

The medium storage box may further comprise a main path for connecting the printing apparatus and the temporary medium stacker. The reversal unit may comprise a first transfer path diverged from the main path and a second transfer path for connecting the first transfer path and the second transfer path.

The reversal unit may further comprise a first diverter provided in a connection portion between the main path and the first transfer path, a second diverter provided in a connection portion between the first transfer path and the second transfer path, and a third diverter provided in a connection portion between the main path and the second transfer path.

The reversal unit may further comprise a first transfer guide for forming a transfer path of the medium and a second transfer guide for forming the transfer path of the medium together with the first transfer guide and movable with respect to the first transfer guide. The printing apparatus may be mounted on the second transfer guide.

The medium storage box may further comprise a sensing unit for sensing whether the printing apparatus is mounted.

The sensing unit may comprise a sensor part provided on one of the first transfer guide and the second transfer guide and a prism provided on the other of the first transfer guide and the second transfer guide.

The sensing unit may comprise a light emitting sensor provided on one of the first transfer guide and the second transfer guide and a light receiving sensor provided on the other of the first transfer guide and the second transfer guide.

The second transfer guide may be rotatable on a hinge axis, and the reversal unit may further comprise an elastic member for providing the second transfer guide with a rotational force for allowing the second transfer guide to rotate on the hinge axis not to form the transfer path.

The first transfer guide and the second transfer guide may be provided with a roller, respectively. When the printing apparatus is mounted, the roller of the second transfer guide may pressurize the roller of the first transfer guide, and when the printing apparatus is separated, the second transfer guide may be separated from the second transfer guide due to a repulsive force between the rollers.

In another embodiment, a financial device comprises a depositing and withdrawing unit for allowing medium to be deposited or withdrawn, a temporary medium stacker for temporarily stacking the medium deposited through the depositing and withdrawing unit, a printing apparatus for printing the deposited medium, a reversal unit for reversing the deposited medium When it is necessary to reverse the deposited medium, and a medium deposit box for storing printed medium for deposit. The deposited medium is reversed by the reversal unit before being printed by the printing apparatus.

The financial device may further comprise a medium storage box for storing medium for withdrawal. The temporary medium stacker, the printing apparatus, and the reversal unit may be located inside the medium storage box.

The financial device may further comprise a deposit path for allowing the deposited medium to be transferred to the temporary medium stacker while detouring the printing apparatus and a withdrawal path for allowing the medium for being printed to be transferred from the temporary medium stacker while passing through the printing apparatus.

The reversal unit may further comprise a first transfer guide for forming a transfer path of the medium and a second transfer guide for forming the transfer path of the medium together with the first transfer guide and movable with respect to the first transfer guide. The printing apparatus may be mounted on the second transfer guide.

The second transfer guide may be rotatable on a hinge axis, and the reversal unit may further comprise an elastic member providing the second transfer guide with a rotational force for allowing the second transfer guide to rotate on the hinge axis not to form the transfer path.

Advantageous Effects

According to the embodiments, since banknotes and/or checks may be deposited or withdrawn as a bundle through a single medium depositing and withdrawing unit, time consumed for depositing or withdrawing decreases and convenience of user's increases.

Also, a printing apparatus is disposed in a check storage box and checks for deposit are temporarily stacked in the check storage box, thereby increasing space availability of an inner space of a financial device.

Also, since checks may be reversed by a reversal unit, the checks may be deposited regardless of front and rear directions of the checks and printing of deposited checks may be performed by a single printing apparatus.

Also, since a deposit path and a withdrawal path are distinguished and checks deposited into a check storage box pass through the deposit path and are stacked on a temporary check stacker, a speed of stacking checks increases.

Also, the checks deposited into the check storage box are stacked on the temporary check stacker without passing through the printing apparatus, thereby preventing the checks from being caught by the printing apparatus while the checks are being transferred.

Also, according to the embodiments, using a single sensing unit, it is possible to sense not only a medium but also whether the printing apparatus is mounted, thereby simplifying the configuration of the check storage box and reducing manufacturing costs.

MODE FOR CARRYING OUT THE INVENTION

Figure 1:
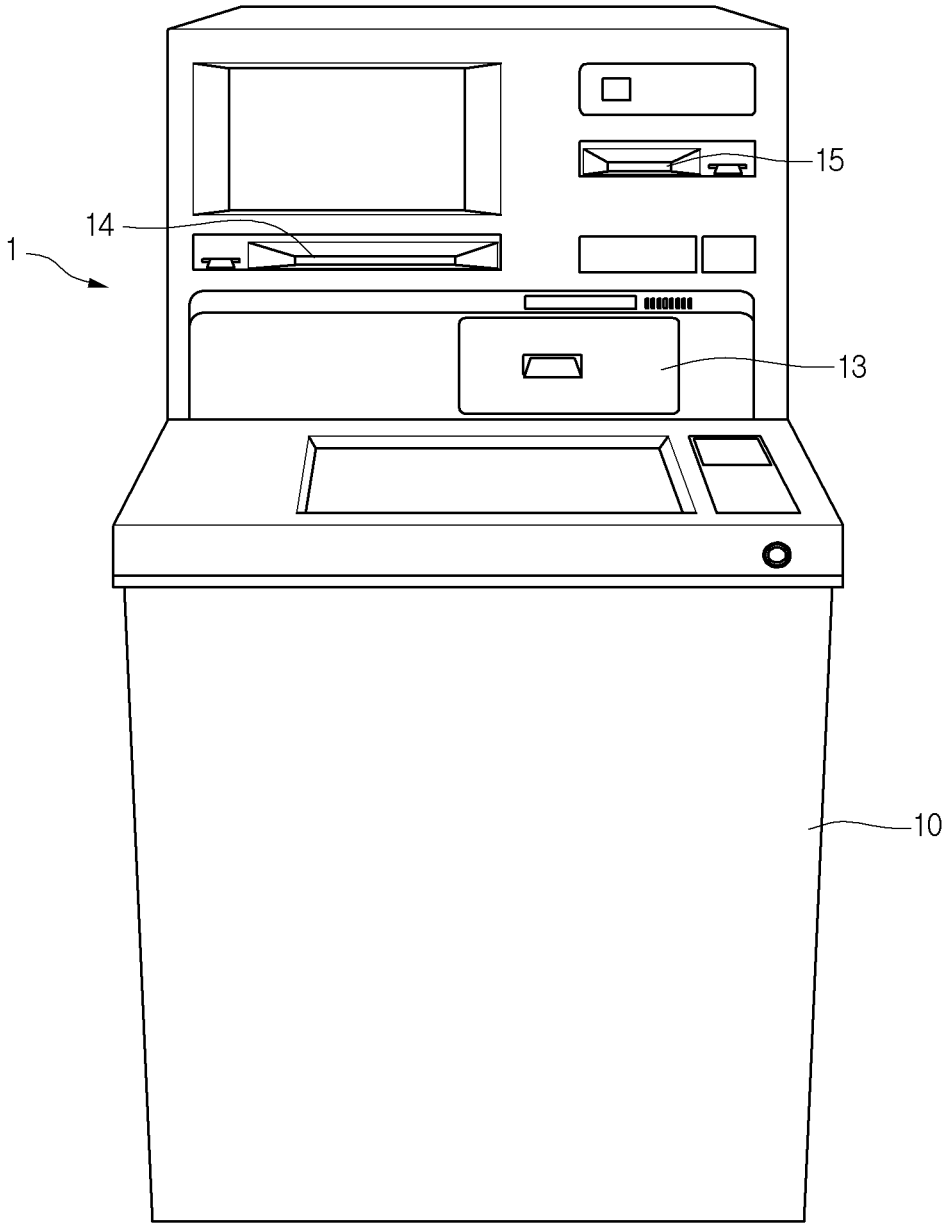
FIG. 1 is a perspective view of a financial device according to a first embodiment of the present invention.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Also, the spirit of the present invention is not limited to respective embodiments themselves but comprises embodiments derived by combining two or more embodiments.

Figure 2:
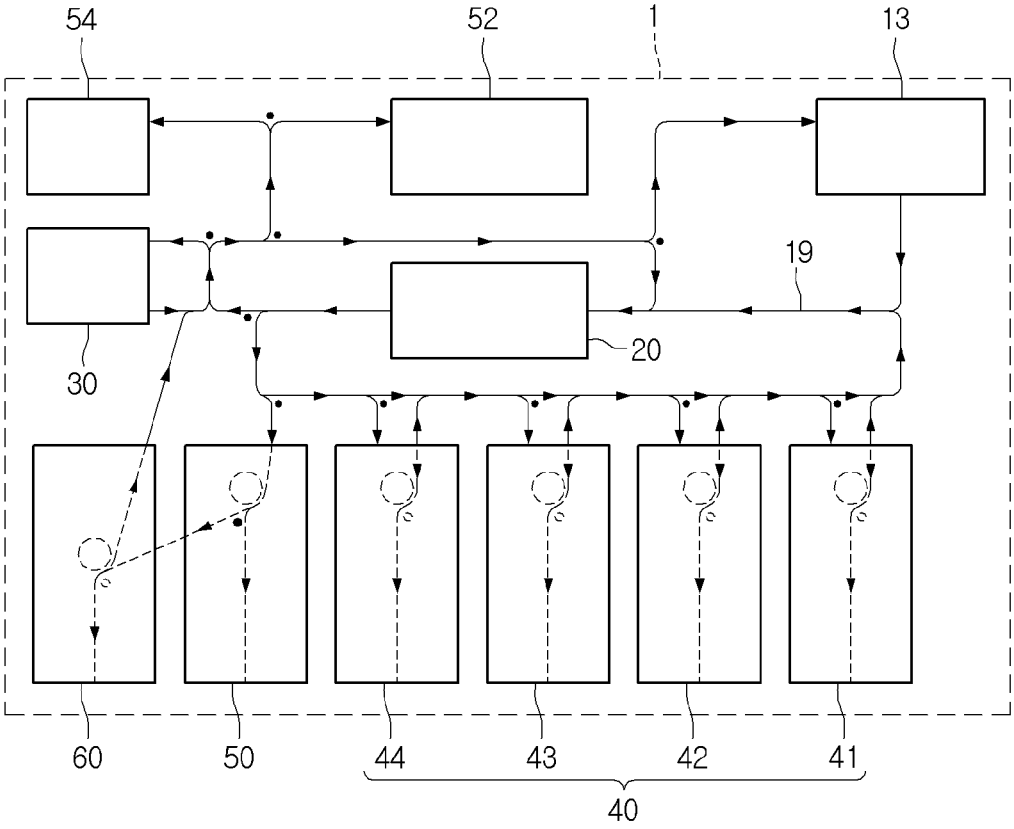
FIG. 2 is a configuration diagram of the financial device of FIG. 1.

FIG. 1 is a perspective view of a financial device 1 according to a first embodiment of the present invention, and FIG. 2 is a configuration diagram of the financial device 1.

Referring to FIGS. 1 and 2, the financial device 1 comprises a body 10 built with a plurality of components therein. The body 10 may comprise a medium depositing and withdrawing unit 13 for depositing or withdrawing banknotes and checks together.

The medium depositing and withdrawing unit 13 comprises a medium storage space allowing a customer to access, which may be opened and closed by a shielding element such as a shutter or a cover and may occasionally be maintained as being opened. Also, the medium depositing and withdrawing unit 13 allows a plurality of banknotes and a plurality of checks to be deposited at the same time. That is, the medium depositing and withdrawing unit 13 is a common depositing and withdrawing unit for banknotes and checks and allows one or more kinds of banknotes and checks to be deposited into the medium depositing and withdrawing unit 13 as a bundle comprising sheets thereof. Also, one or more kinds of banknotes and checks may be withdrawn through the medium depositing and withdrawing unit 13 as a bundle. Also, the banknotes and checks may be deposited into or withdrawn from the medium depositing and withdrawing unit 13 in the same direction. Also, the banknotes and checks may be deposited regardless of a front and a rear thereof. The medium depositing and withdrawing unit 13 may comprise a separator for separating a deposited bundle of banknotes or checks into a sheet thereof.

Herein, depositing or withdrawing the banknotes and checks in the same direction indicates depositing or withdrawing the banknotes and checks in a lateral direction or in a longitudinal direction. The lateral direction indicates a direction parallel to a short side of a banknote or check. The longitudinal direction indicates a direction parallel to a long side of a banknote or check. Also, being regardless of the front and the rear of the banknotes and checks indicates being regardless of which one of the front and the rear of the banknotes and checks is allowed to face upwards.

Also, the financial device 1 may further comprise a bankbook inserting and discharging unit 14 for inserting and discharging a bankbook and a card inserting and discharging unit 15 for inserting and discharging a card. According to a kind of the financial device 1, one or more of the bankbook inserting and discharging unit 14 and the card inserting and discharging unit 15 may be omitted.

Also, the financial device 1 may further comprise a discrimination unit 20. The discrimination unit 20 may identify the kind of media or discriminating and separating bad medium while medium being deposited or withdrawn. In the present embodiment, the discrimination unit 20 may discriminate, for example, the state of banknotes and checks. Between the medium depositing and withdrawing unit 13 and the discrimination unit 20, a transfer unit 19 for transferring banknotes and checks in common may be provided. The discrimination unit 20 may comprise one or more of an optical character reader (OCR) and a magnetic ink character reader (MICR).

Also, the financial device 1 may further comprise a temporary banknote stacker 30 for temporarily stacking banknotes. The temporary banknote stacker 30, when a customer would like to deposit banknotes in the financial device 1, temporarily stores the banknotes deposited through the medium depositing and withdrawing unit 13. The banknotes stacked in the temporary banknote stacker 30, when the customer finally determines receipt of the banknotes, may be transferred to banknote storage boxes 41, 42, and 43, which will be described below.

The financial device 1 may further comprise a medium storage box 40 for storing medium. The medium storage box 40 may comprise one or more banknote storage boxes 41, 42, and 43 and at least one check storage box 44. In the specification, there is no limitation in the number of banknote storage boxes and check storage boxes.

The banknote storage boxes 41, 42, and 43 may be provided with a medium inlet for allowing transferred banknotes to be deposited therethrough and a medium outlet for allowing stacked banknotes inside the banknote storage boxes 41, 42, and 43 to be withdrawn outwards. Generally, the medium inlet and the medium outlet may be formed on a top of a box forming an exterior of each of the medium storage boxes 41, 42, and 43. However, in the embodiment, there is no limitation in locations of the medium inlet and the medium outlet in the banknote storage box.

Also, the banknote storage boxes 41, 42, and 43 are provided with a medium stacking unit for stacking banknotes transferred from the outside of the banknote storage boxes 41, 42, and 43 and a medium pickup unit for separating stacked banknotes one by one and transferring outwards from the banknote storage boxes 41, 42, and 43 together therein. That is, banknotes stacked in the banknote storage boxes 41, 42, and 43 may be withdrawn outwards from the banknote storage boxes 41, 42, and 43 and deposited banknotes may be stacked in the banknote storage boxes 41, 42, and 43. The banknote storage boxes 41, 42, and 43 may have a previously well-known configuration. In the embodiment, the configuration of the banknote storage boxes 41, 42, and 43 and whether a capability of depositing or withdrawing of banknotes are not limited to examples described above.

The medium storage boxes 41, 42, and 43 may be formed lengthways in a direction parallel to a direction of gravity to allow medium to be stacked in the direction of gravity and may be disposed on a bottom in the financial device 1. When the financial device 1 comprises a plurality of banknote storage boxes 41, 42, and 43, the plurality of banknote storage boxes 41, 42, and 43 may be disposed horizontally. As another example, the plurality of banknote storage boxes 41, 42, and 43 may be disposed perpendicularly.

The check storage box 44 may be disposed horizontally together with the plurality of banknote storage boxes 41, 42, and 43. As another example, the check storage box 44 may be disposed perpendicularly together with the plurality of banknote storage boxes 41, 42, and 43. The check storage box 44 may store checks to be withdrawn. A configuration of the check storage box 44 will be described with reference to the drawings.

The financial device 1 may further comprise a check deposit box or a medium deposit box 54. The check deposit box 54 may store checks normally deposited. The check deposit box 54 and the check storage box 44 may be separate individual modules. As another example, the check deposit box 54 and the check storage box 44 may be provided in a single storage box, and merely, an inner space of the single storage box may be divided into a space for storing checks to be deposited and a space for checks to be withdrawn.

The financial device 1 may further comprise one or more of a first collection box 50 for storing banknotes or checks determined to be defective during a deposit process, a second collection box 52 for storing banknotes or checks determined to be defective during a withdrawal process, and a collection and supplement box 60. The first collection box 50 and the second collection box 52 may be provided as pluralities thereof, respectively, and may be used as check collection boxes and banknote collection boxes, respectively.

The collection and supplement box 60 may supplement the banknote storage boxes 41, 42, and 43 or the check storage boxes with banknotes or checks or may collect banknotes or checks from the banknote storage boxes 41, 42, and 43 or the check storage box 44. Otherwise, the financial device 1 may further comprise a third collection box (not shown) for collecting medium withdrawn through the medium depositing and withdrawing unit 13 for withdrawal but not received by a customer.

From the financial device 1, the collection boxes 50 and 52 and the collection and supplement box 60 may be excluded. Also, there is no limitation in the number of the collection boxes 50 and 52 and the collection supplement box 60.

Figure 3:
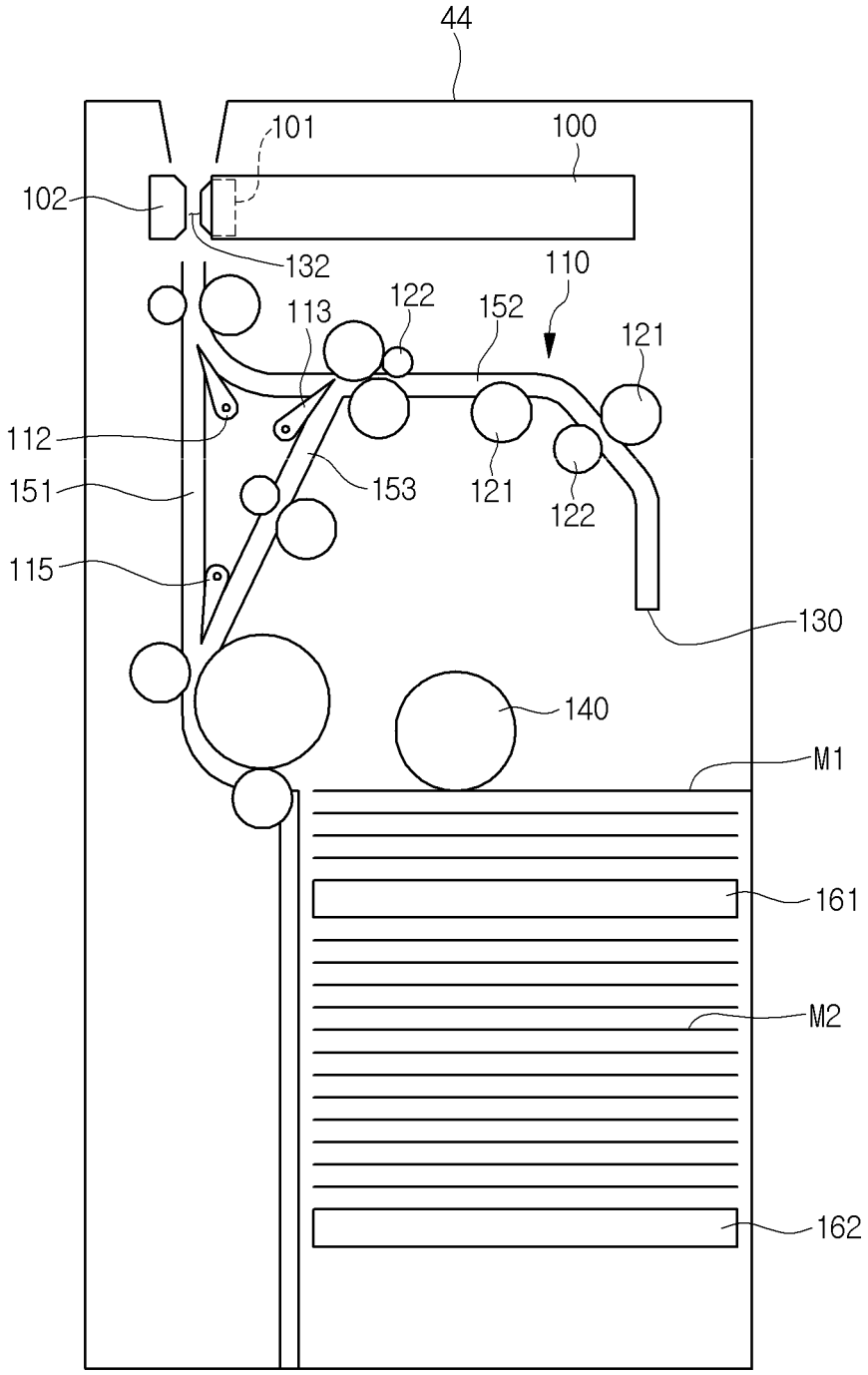
FIG. 3 is a schematic diagram of a check storage box shown in FIG. 2.

FIG. 3 is a schematic diagram of the check storage box 44.

Referring to FIG. 3, in the check storage box 44, checks M1 for deposit may be temporarily stacked and checks M2 for withdrawal may be stored. That is, the check storage box 44 may not only store checks for withdrawal but also allow deposited checks to be temporarily stacked.

The check storage box 44 may comprise a printing apparatus 100 for printing of checks, a main path 151 for transferring checks, a reversal unit 110 for a reversal of checks, and a pickup roller 140 for picking up and transferring the checks M1 temporarily stacked or the checks M2 for withdrawal. Also, the check storage box 44 may comprise a first supporting unit 161 for supporting the checks M1 for deposit and a second supporting unit 162 for supporting the checks M2 for withdrawal.

The main path 151 connects the printing apparatus 100 and a temporary check stacker.

The checks M2 for withdrawal may be disposed between the first supporting unit 161 and the second supporting unit 162. Also, the checks M1 for deposit may be disposed on a top of the first supporting unit 161. A space between the first supporting unit 161 and the second supporting unit 162 may be designated as a check storage unit. The first supporting unit 161 and the second supporting unit 162 may be vertically moved by independent driving units. In the embodiment, the first supporting unit 161 and the second supporting unit 162 may be vertically moved, thereby allowing a location and a size of the check storage unit to be variable.

As another example, the second supporting unit 162 may be vertically moved by the driving unit and the first supporting unit 161 may be connected to an elastic member (not shown). The elastic member may provide the first supporting unit 161 with an elastic force for allowing the first supporting unit 161 to be moved downwards. In this case, while an external force is not applied to the first supporting unit 161, the first supporting unit 161 may maintain a state shown in FIG. 3. When the second supporting unit 162 ascends, an ascending force of the second supporting unit 162 is transferred to the first supporting unit 161 by the checks M2 for withdrawal, thereby allowing the first supporting unit 161 to ascend. In this case, the first supporting unit 161 may ascend to a higher location than a lowest point of the pickup roller 140 while not mutually interfering with the pickup roller 140. Not to allow the first supporting unit 161 and the pickup roller 140 to interfere with each other, the supporting unit 161 may be provided with an opening to allow the pickup roller 140 to pass through.

When the first supporting unit 161 is operated by the driving unit, the first supporting unit 161 may ascend higher than the lowest point of the pickup roller 140.

In the present embodiment, as far as the checks M1 for deposit and the checks M2 for withdrawal may be stored while being separated from each other in the check storage box 44, the configuration is not limited to the described above and various configurations may be applied.

According to the present embodiment, since the checks M1 for deposit are temporarily stacked in the check storage box 44, an additional temporary check stacker is unnecessary. The temporary check stacker may well be provided separately from the check storage box 44.

The printing apparatus 100 may comprise a printing head 101 for printing checks and a transfer guide 102 disposed in a location separate from the printing head 101. That is, the printing head 101 and the transfer guide 102 are modularized, thereby configuring the printing apparatus 100. Differently, the transfer guide 102 may be formed separately from the printing apparatus 100 and may be installed in a location opposite to the printing head 101 in the check storage box 44. In this case, while the transfer guide 102 is being located in the check storage box 44, the printing apparatus 100 may be separate from the check storage box 44.

The transfer guide 102 may be horizontally separate from the printing head 101, as an example. Accordingly, checks are allowed to pass through a path 132 between the transfer guide 102 and the printing head 101.

The reversal unit 110 reverses checks. When depositing checks, printing is performed on a rear of a check. When withdrawing checks, printing is performed on a front of a check. Herein, when a deposited check is transferred while a front of the check is facing the printing head 101, the reversal unit 110 reverses the check to allow a rear of the check to face the printing head 101.

The reversal unit 110 comprises a first transfer path 152 for diverging from the main path 151, and a second transfer path 153 for diverging from the first transfer path 152 to connect the first transfer path 152 and the main transfer path 151. The second transfer path 153 may be connected to one point of the first transfer path 152.

Also, the reversal unit 110 may comprise a first diverter 112 located in a portion where the main path 151 and the first transfer path 152 meet each other, a second diverter located in a portion where the first transfer path 152 and the second transfer path 153 meet each other, and a third diverter 115 located in a portion where the main path 151 and the second transfer path 153 meet each other. The respective diverters 112, 113, and 115 may control a transfer direction of checks. Also, the first transfer path 152 may comprise a supporting unit 130 for supporting transferred checks on an end thereof. The first diverter 112 and the third diverter 115 may be operated by an actuator (not shown). On the contrary, the second diverter 113 may be operated without the actuator by a transfer force of checks while the checks are being transferred. Justly, the second diverter 113 may be operated by the actuator.

Also, the reversal unit 110 may comprise at least one driving roller 121 and at least one pinch roller 122 to transfer medium on the first transfer path 152. The driving roller 121 and the pinch roller 122 may be driven by mutually independent driving units. As another example, the pinch roller 122 may be configured to rotate due to friction with checks while transferring the checks. Also, the driving roller 121 and pinch roller 122 may bidirectionally rotate, respectively.

The pinch roller 122 and the driving roller 121 may be located on opposite sides with reference to checks on the first transfer path. In the present embodiment, the skew of checks may be prevented by adjusting the rotational numbers of the driving roller 121 and the pinch roller 122.

Figure 4:
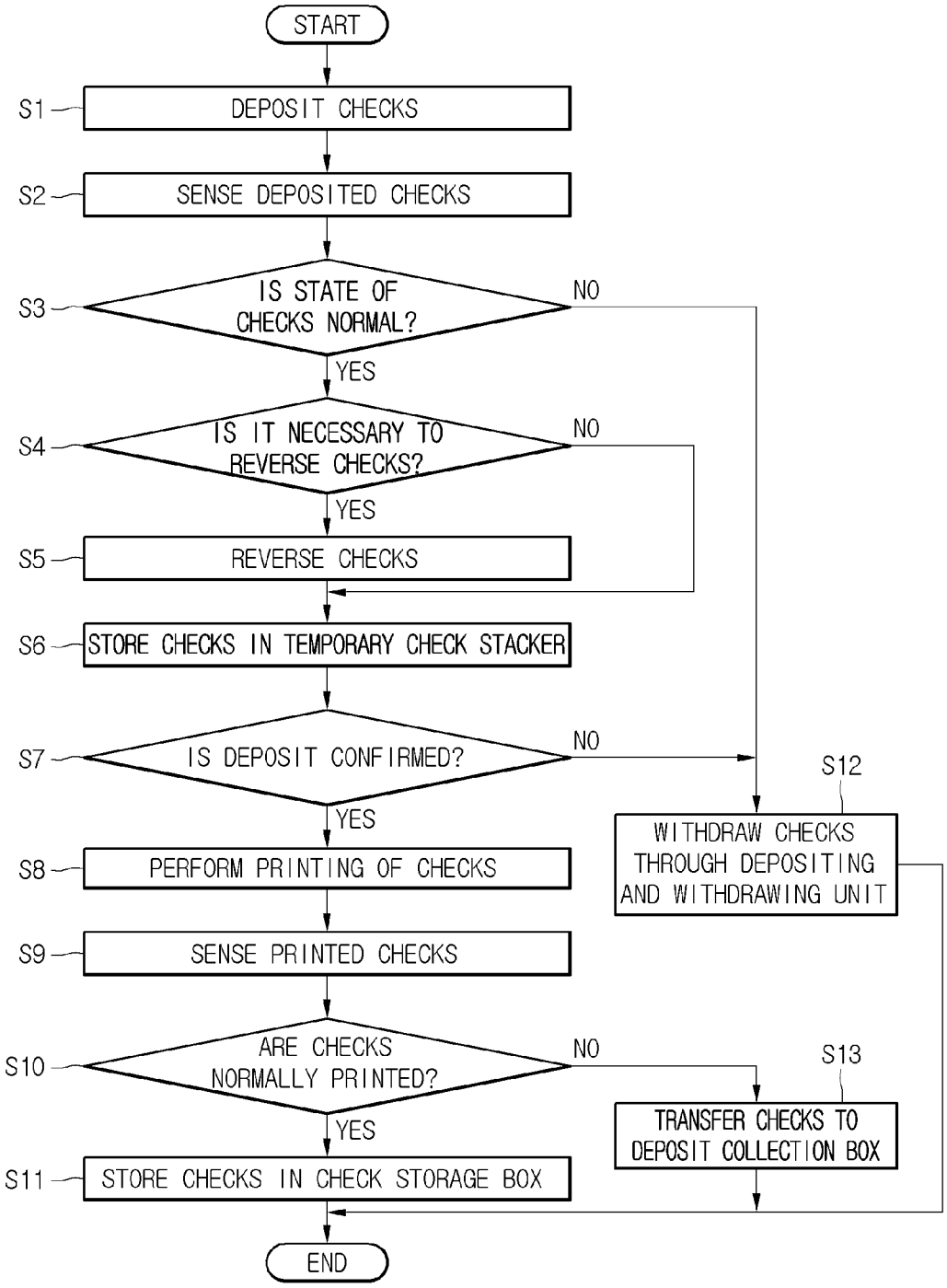
FIG. 4 is a flowchart illustrating a process of depositing checks according to the first embodiment of the present invention.
Figure 5:
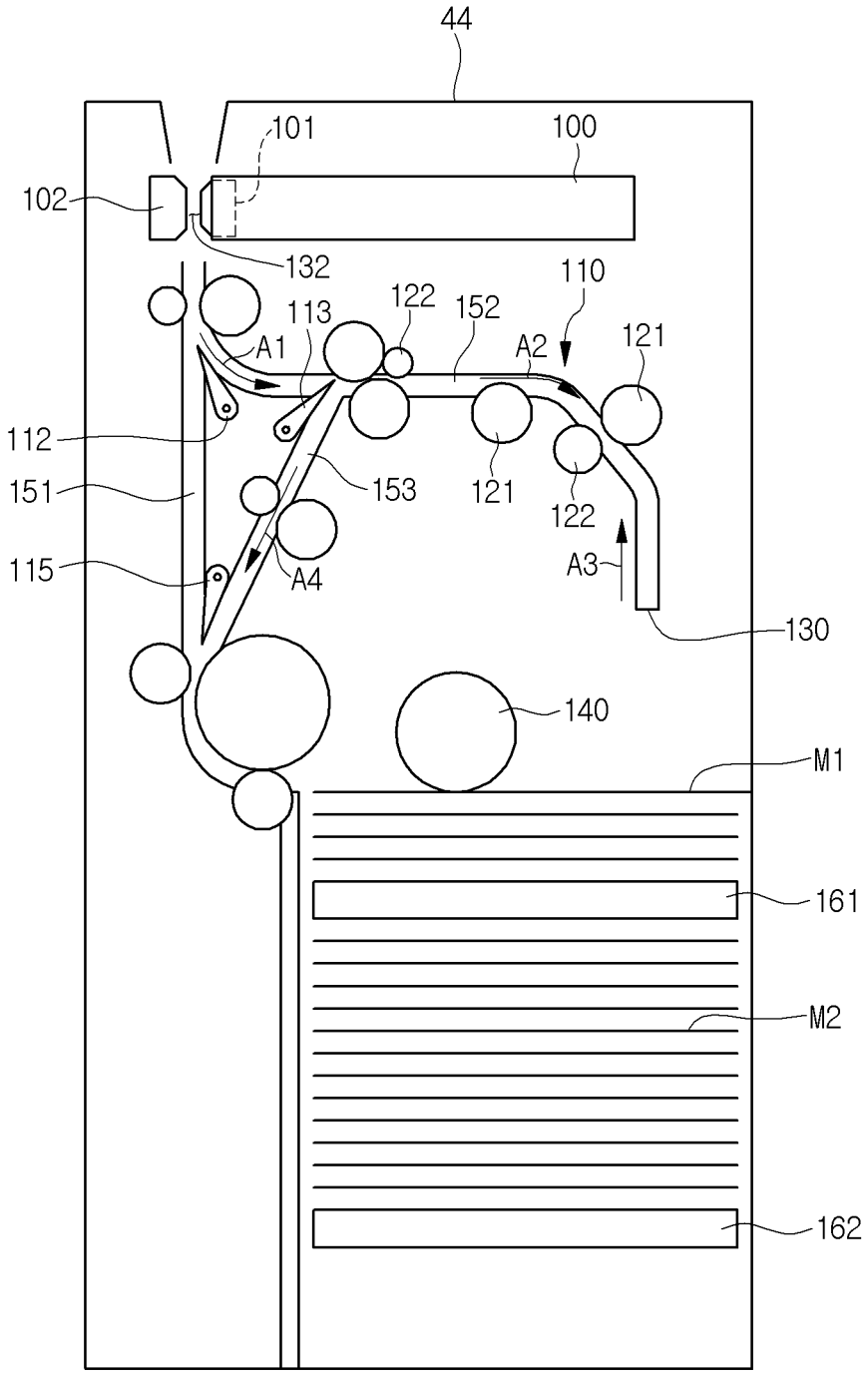
FIG. 5 is a diagram illustrating a transfer path of checks in the check storage box when depositing the checks according to the first embodiment of the present invention.

FIG. 4 is a flowchart illustrating a process of depositing checks according to the first embodiment of the present invention, and FIG. 5 is a diagram illustrating a transfer path of checks in the check storage box 44 when depositing the checks according to the first embodiment of the present invention.

Referring to FIGS. 3 to 5, checks are deposited for deposit of the checks (51). Hereinafter, as an example, it will be described that the checks are deposited laterally. As described above, the checks may be deposited as a bundle comprising sheets and may be deposited together with banknotes. Otherwise, only banknotes may be deposited as a bundle comprising sheets. In FIG. 5, as an example, the process of depositing checks will be described. Since a process of depositing banknotes may be similar to general well-known processes, a detailed description thereof will be omitted.

After being deposited, the checks are transferred laterally to the discrimination unit 20. The discrimination unit 20 senses a state of the deposited checks (S2).

After that, the discrimination unit 20 or a control unit (not shown) determines whether the deposited checks are normal (S3). When the deposited checks are normal, the discrimination unit 20 or the control unit determines whether it is necessary to reverse the deposited checks (S4). It may be determined based on a state of the checks recognized by the discrimination unit 20 whether to reverse the checks.

When it is necessary to reverse the deposited checks, the deposited checks are reversed by the reversal unit 110 after being inputted into the check storage box 44 (S5).

In detail, the checks deposited into the check storage box 44 are allowed to be transferred by the first diverter 112 to the first transfer path 152 (an arrow A1). After that, the checks are transferred by unidirectional rotations of the driving roller 121 and the pinch roller 122 and mounted on the supporting unit 130 (an arrow A2). After that, the checks on the supporting unit 130 are transferred along the first transfer path 152 by rotations of the driving roller 121 and the pinch roller 122 in an opposite direction (an arrow A3).

While the checks are being transferred along the first transfer path 152, the checks are transferred to the second transfer path 153 by the second diverter 113 (an arrow A4). The checks transferred along the second transfer path 153 are transferred to the main path 151 and then are stacked on the top of the first supporting unit 161. That is, checks M1 reversed by the reversal unit 110 are stacked in the temporary check stacker (S6).

On the contrary, when the deposited checks are abnormal, the checks are withdrawn through the medium depositing and withdrawing unit 13 (S12).

After that, it is determined whether a customer inputs a deposit confirmation command for the checks (S7). In operation S7, when a deposit cancellation command is inputted, the checks temporarily stacked in the check storage box 44 are withdrawn through the medium depositing and withdrawing unit 13 (S12). Herein, when the deposit cancellation command is inputted, the temporarily stacked checks are picked up by the pickup roller 140 and then are transferred along the main path 151.

In operation S7, when it is determined that the deposit confirmation command for the checks is inputted, printing of the checks M1 temporarily stacked in the check storage box 44 is performed (S8).

In detail, the checks M1 temporarily stacked in the check storage box 44 stop while being transferred to the path 132 between the printing head 101 and the transfer guide 102. After that, while the checks M1 are stopping, the printing head 101 may perform printing while being moved by a head moving unit (not shown) in a longitudinal direction of the checks M1.

In the embodiment, a printing direction of the checks is a longitudinal direction, in which the printing head 101 is moved, and a direction, in which the checks are transferred to the printing apparatus 100, is a lateral direction. Accordingly, in the embodiment, it may be understood that the transfer direction of the checks and the printing direction of the printing apparatus 100 intersect with each other.

As another example, the financial device 1 may be provided with a diversion unit for changing the transfer direction of the deposited checks before the checks are inputted into the check storage box 44. In this case, a transfer direction of checks deposited laterally may be diverted to be longitudinally by the diversion unit. Herein, the checks may be longitudinally inputted into the check storage box 44 and longitudinally withdrawn from the check storage box 44. In this case, while the checks are being transferred, printing may be performed by the printing head 101. That is, the printing of the checks may be performed by the printing head 101 while not being moved and stopping.

When the printing of the checks is finished, the checks are allowed to pass through the discrimination unit 20. The discrimination unit 20 senses a state of the printed checks (S9). Also, the control unit 70 determines whether the checks are normally printed (S10). When it is determined that the printing of the checks is normally performed, the checks are stored in the check deposit box 54 (S11). On the contrary, when it is determined that the checks are not normally printed, the checks are transferred to a deposit collection box, that is, the first collection box 50 (S13).

Figure 6:
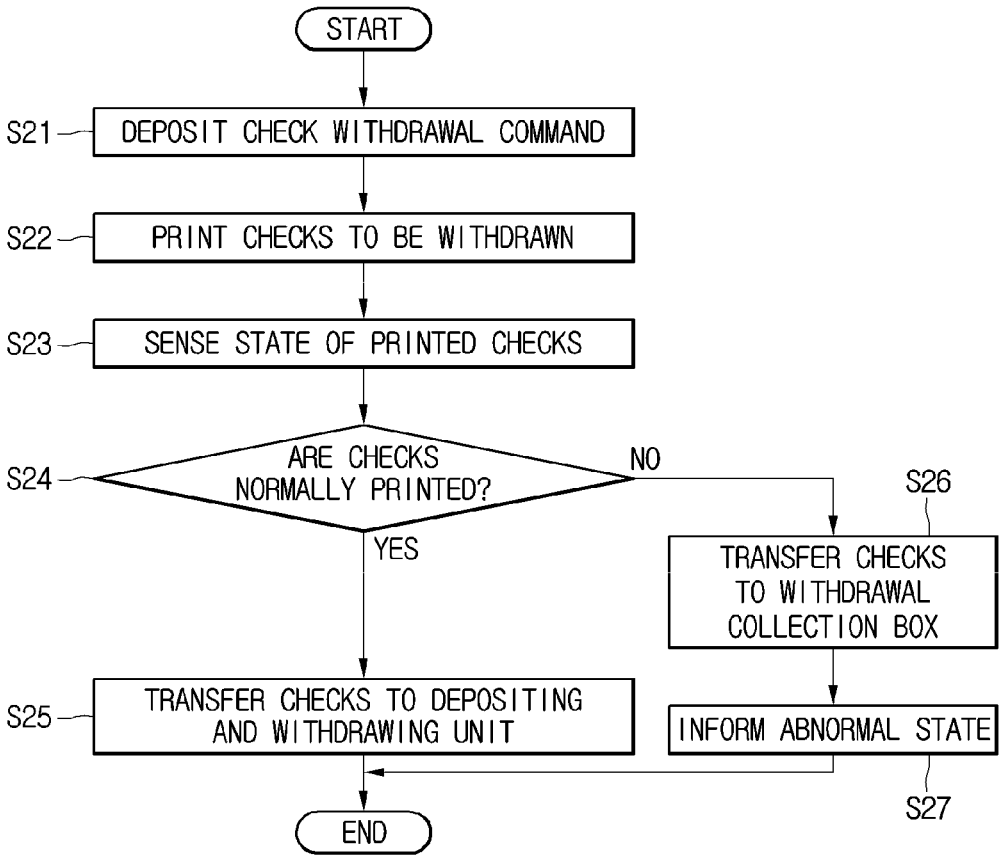
FIG. 6 is a flowchart illustrating a process of withdrawing checks according to the first embodiment of the present invention.

FIG. 6 is a flowchart illustrating a process of withdrawing checks according to the first embodiment of the present invention.

Referring to FIGS. 3 and 6, a check withdrawal command for withdrawing checks is inputted (S21). When the check withdrawal command is inputted, the first supporting unit 161 and the second supporting unit 162 ascend. The first supporting unit 161 ascends to a location higher than the lowest point of the pickup roller 140. Herein, the checks M2 for withdrawal are picked up by the pickup roller 140. The picked up checks M2 are transferred along the main path 151.

After that, the checks for withdrawal are printed (S22). Herein, since it is necessary to perform printing on a front of a check when withdrawing the check as described above, the checks M2 are transferred while the front of the checks M2 is facing the printing head 101. That is, the checks M2 are stacked on the second supporting unit 162 to allow the front of the checks M2 to face upwards.

When the printing is finished, the checks M2 are allowed to pass through the discrimination unit 20. The discrimination unit 20 senses a state of the printed checks M2 (S23). Also, the control unit or the discrimination unit 20 determines whether the checks M2 are normally printed (S24). When it is determined that the printing of the checks M2 is normally performed, the checks M2 are transferred to the medium depositing and withdrawing unit 13 to be withdrawn. On the contrary, when it is determined that the printing of the checks M2 is not normally performed, the checks M2 is transferred to a withdrawal collection box, that is, the second collection box 52 (S26). When the checks M2 are transferred to the withdrawal collection box, abnormal state information may be known outwards (S27). For example, the abnormal state information may be notified as a voice or a text through a display unit or a notification unit.

In the present embodiment, since banknotes and/or checks may be deposited or withdrawn as a bundle through a single medium depositing and withdrawing unit, time consumed for depositing or withdrawing decreases and convenience of user's increases.

Also, a printing apparatus is disposed in a check storage box and checks for deposit are temporarily stacked in the check storage box, thereby increasing space availability of an inner space of a financial device.

Also, since checks may be reversed by a reversal unit, checks may be deposited regardless of front and rear directions of the checks and printing of deposited checks may be performed by a single printing apparatus.

In the embodiment, printing of checks has been described. Differently, the inventive concept may be applied as it is to printing of other medium in addition to the checks.

Figure 7:
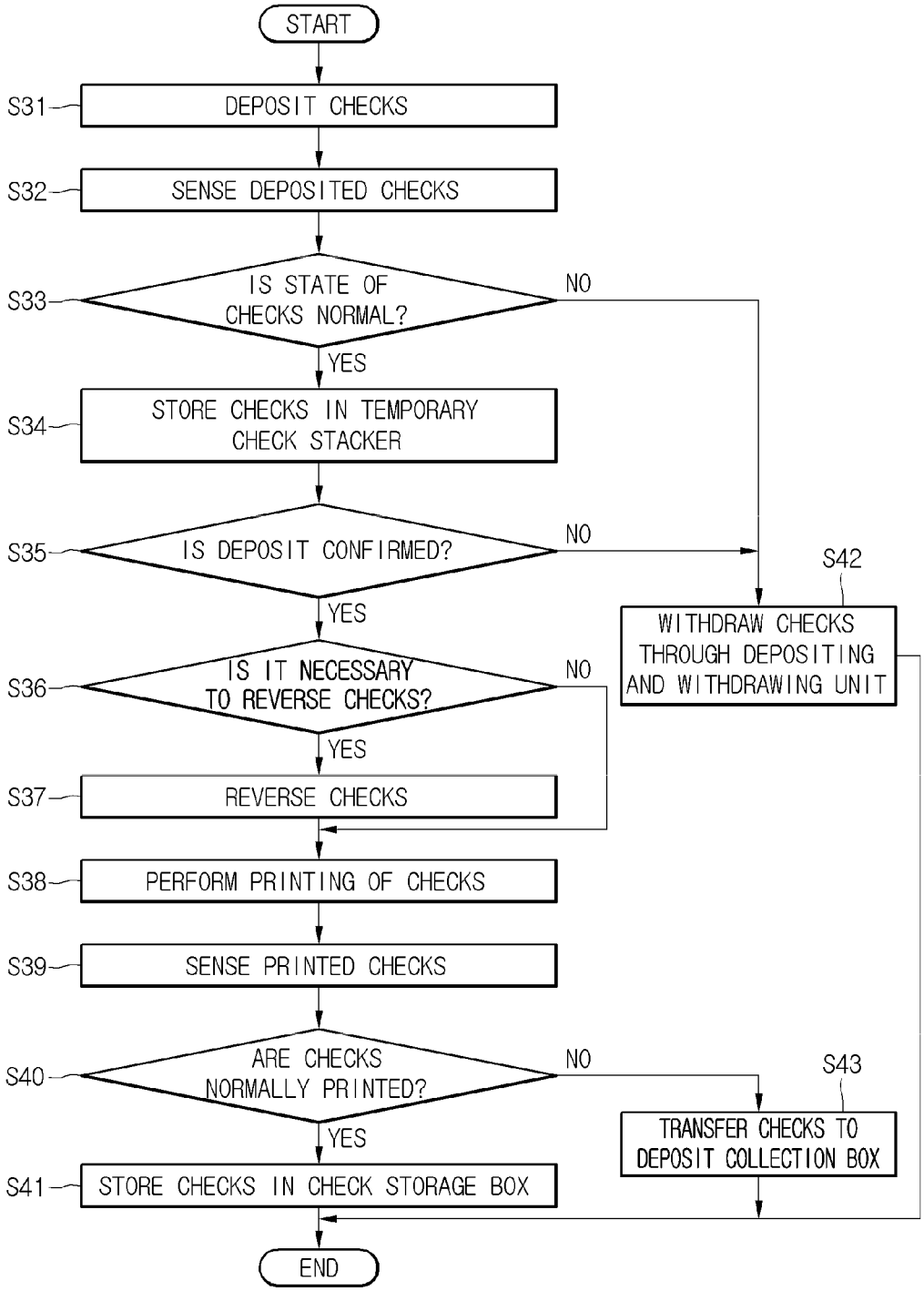
FIG. 7 is a flowchart illustrating a process of depositing checks according to a second embodiment of the present invention.
Figure 8:
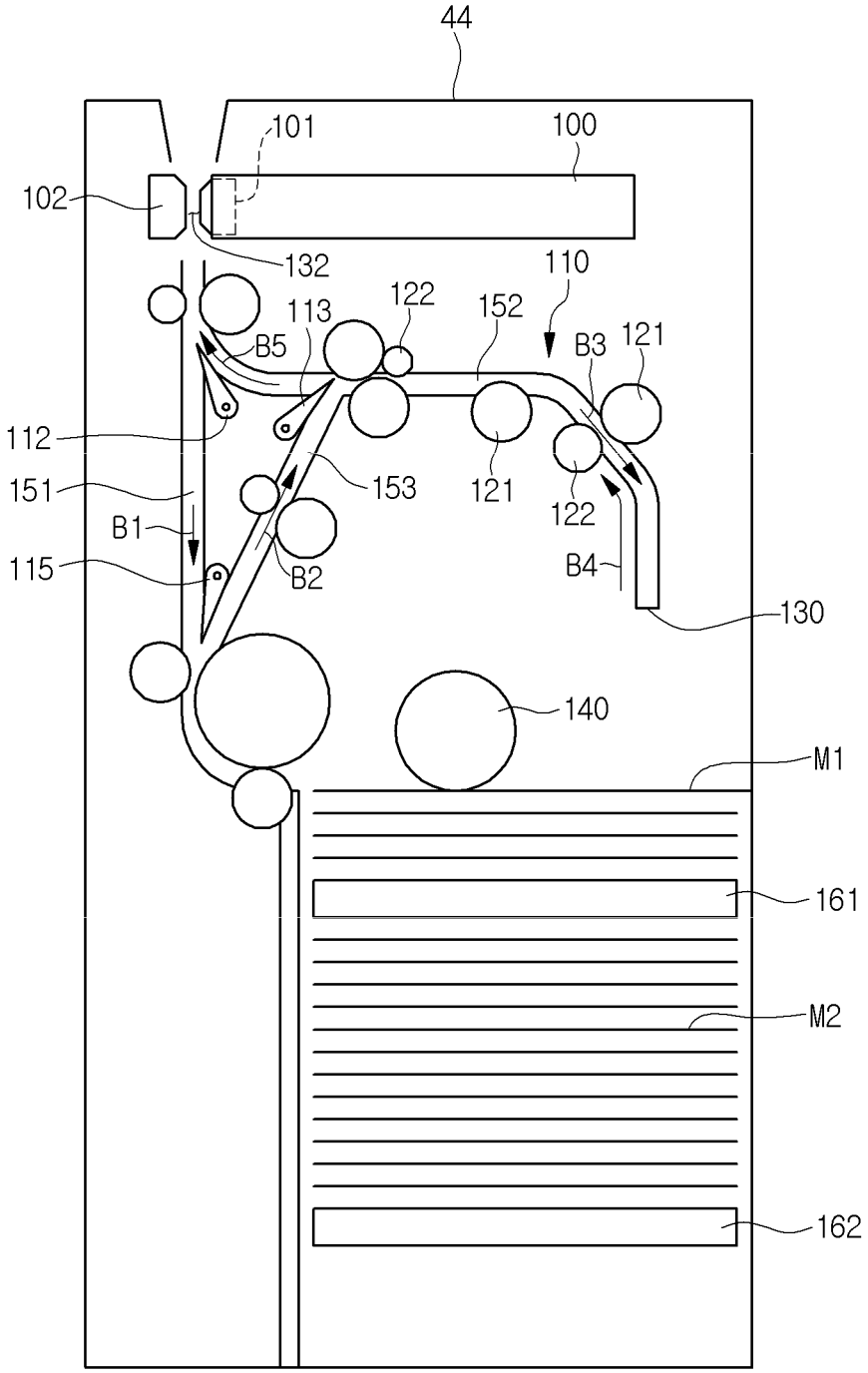
FIG. 8 is a diagram illustrating a transfer path of checks in the check storage box when depositing the checks according to the second embodiment of the present invention.

FIG. 7 is a flowchart illustrating a process of depositing checks according to a second embodiment of the present invention, and FIG. 8 is a diagram illustrating a transfer path of checks in the check storage box 44 when depositing the checks according to the second embodiment of the present invention.

In the second embodiment, a configuration of a reversal unit is identical to the reversal unit 110 of the first embodiment. Merely, there is a difference in a point of time for operation of the reversal unit, that is, a point in time for reversing checks. Accordingly, hereinafter, only particular parts of the second embodiment will be described.

Referring to FIGS. 7 and 8, checks are deposited for deposit of the checks (S31). Hereinafter, as an example, it will be described that the checks are deposited laterally. After being deposited, the checks are transferred laterally to the discrimination unit 20. The discrimination unit 20 senses a state of the deposited checks (S32).

After that, the discrimination unit 20 or a control unit (not shown) determines whether the deposited checks are normal (S33). When the deposited checks are normal, the checks M1 are temporarily stored in the temporary check stacker (S34). In detail, when the deposited checks are normal, the checks M1 are transferred along the main path 151 by the first diverter 112 and stacked on the top of the first supporting unit 161 (an arrow B1).

On the contrary, when the deposited checks are abnormal, the checks are withdrawn through the medium depositing and withdrawing unit 13 (S42).

After that, it is determined whether a customer inputs a deposit confirmation command for the checks (S35). In operation S35, when a deposit cancellation command is inputted, the checks M1 temporarily stacked in the check storage box 44 are withdrawn through the medium depositing and withdrawing unit 13 (S42). When the deposit cancellation command is inputted, the temporarily stacked checks M1 are picked up by the pickup roller 140 and then are transferred along the main path 151.

In operation S35, when it is determined that the deposit confirmation command for the checks is inputted, it is determined whether it is necessary to reverse the checks M1 (S36). When it is necessary to reverse the checks M1, the checks M1 are reversed by the reversal unit 110 (S37). Herein, since the state of the checks is determined by the discrimination unit 20 before temporarily stacking the checks M1, the determined state of the checks is stored in a memory (not shown). When the deposit confirmation command for the checks M1 is inputted, the state of the checks M1 stored in the memory is recognized, thereby determining whether it is necessary to reverse the checks M1.

In detail, the checks M1 picked up by the pickup roller 140 are transferred to the second transfer path 153 by the third diverter 115 (an arrow B2). After that, the checks on the second transfer path 153 are transferred to the first transfer path 152 by the second diverter 113. The checks transferred to the first transfer path 152 are transferred by unidirectional rotations of the driving roller 121 and the pinch roller 122 and mounted on the supporting unit 130 (an arrow B3). After that, the checks on the supporting unit 130 are transferred along the first transfer path 152 and reversed by rotations of the driving roller 121 and the pinch roller 122 in an opposite direction (arrows B4 and B5). The checks M1 completely reversed are transferred to the main path 151 and then printed by the printing head 101 (S38).

When the printing is finished, the checks M1 are allowed to pass through the discrimination unit 20. The discrimination unit 20 senses a state of the printed checks (S39). Also, the discrimination unit 20 or the control unit determines whether the checks M1 are normally printed (S40). When it is determined that the printing of the checks M1 is normally performed, the checks M1 are stored in the check deposit box 54 (S41). On the contrary, when it is determined that the printing of the checks M2 is not normally performed, the checks M1 is transferred to a deposit collection box, that is, the first collection box 50 (S43).

Figure 9:
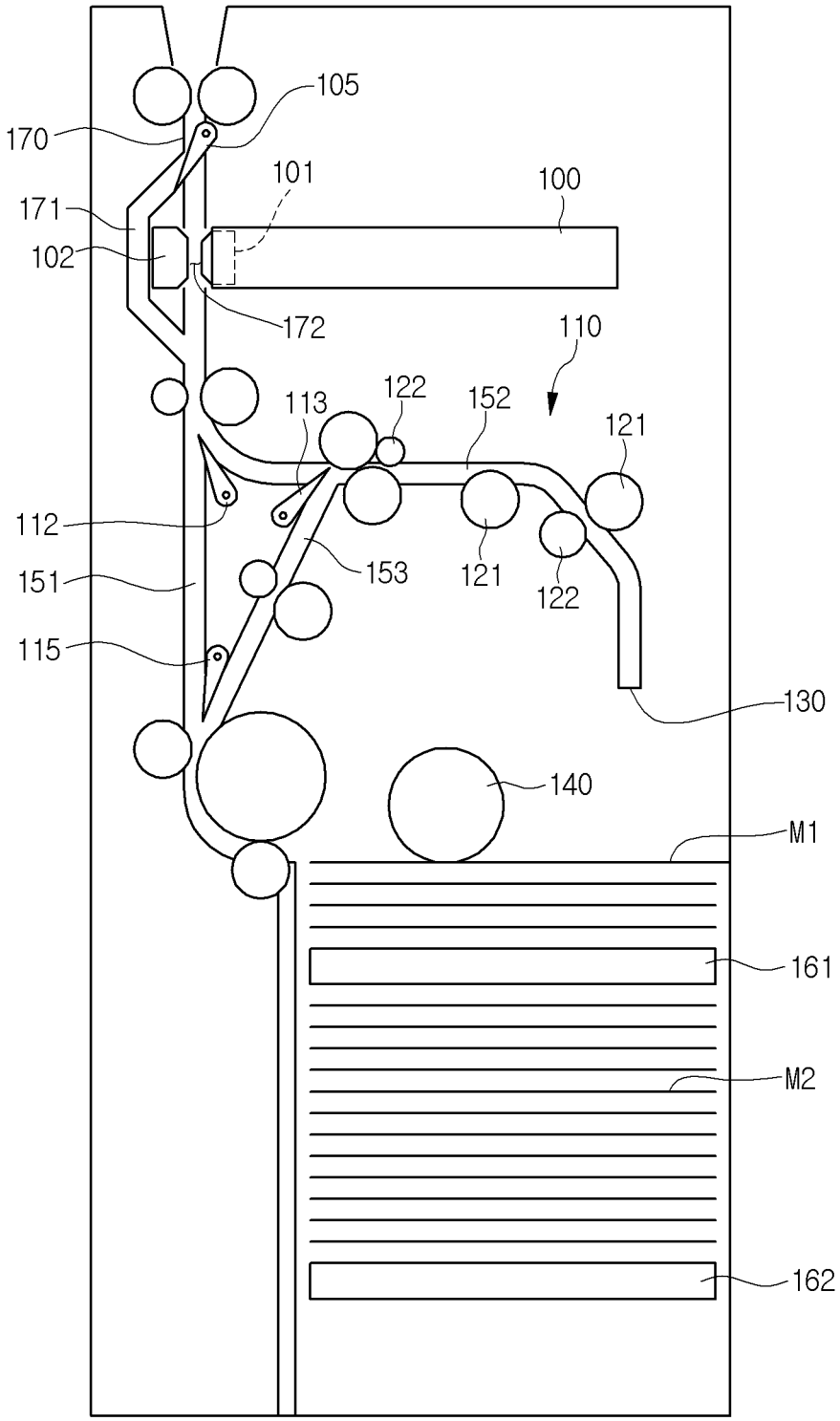
FIG. 9 is a schematic diagram of a check storage box according to a third embodiment of the present invention.

FIG. 9 is a schematic diagram of an example of the check storage box 44 according to a third embodiment of the present invention.

In the present embodiment, other parts are identical to the first embodiment or the second embodiment. Merely, there is a difference in a transfer path of checks in the check storage box 44. Accordingly, hereinafter, only particular parts of the third embodiment will be described.

Referring to FIG. 9, the check storage box 44 according to the third embodiment may comprise the printing apparatus 100 for printing checks, a deposit path 171, on which deposited checks are transferred, and a withdrawal path 172, on which checks for withdrawal are transferred. The deposit path 171 and the withdrawal path 172 are diverged from an depositing and withdrawing path 170, which will be described below, and join together after passing the printing apparatus 100 are connected to the main path 151.

Also, the check storage box 44 may comprise a depositing and withdrawing path 129, the main path 151 connected to the deposit path 171 and the withdrawal path 172, the reversal unit 110 for reversing checks, and the pickup roller 140 for picking up and transferring the checks M2 for withdrawal. Also, the check storage box 44 may comprise the first supporting unit 161 for supporting the checks M1 for deposit and the second supporting unit 162 for supporting the checks M2 for withdrawal.

A part of the depositing and withdrawing path 170, from which the deposit path 171 and the withdrawal path 172 are diverged, may be provided with a diverter 105 for controlling a transfer path of checks. The diverter 105 operates to allow checks deposited to the check storage box 44 to be transferred to the deposit path 171 and to allow checks transferred to the withdrawal path 172 and printed by the printing apparatus 100 to be withdrawn from the check storage box 44 through the depositing and withdrawing path 170.

While checks are being transferred along the withdrawal path 172, printing of the checks is performed. Herein, to perform the printing of the checks, the checks and the printing head 101 are allowed to be in contact with each other. Accordingly, a width of the withdrawal path 172 is formed to be smaller than a width of the deposit path 131. The withdrawal path 172 is provided with a roller to allow checks to be in contact with the printing head 101.

As described in relation to the first embodiment, when the printing apparatus 100 comprises the transfer guide 102, the withdrawal path 172 is formed inside the printing apparatus 100. Differently, when the transfer guide 102 is formed separate from the printing apparatus 100, the withdrawal path 172 is formed outside the printing apparatus 100.

In the present embodiment, checks to be temporarily stacked are transferred along the deposit path 171. Accordingly, while checks are being temporarily stacked, a phenomenon of being caught by components of the printing apparatus 100 may be prevented and the checks may be transferred fast.

Since the reversal unit 110 has the same configuration as described in relation to the first embodiment, a detailed description will be omitted.

Figure 10:
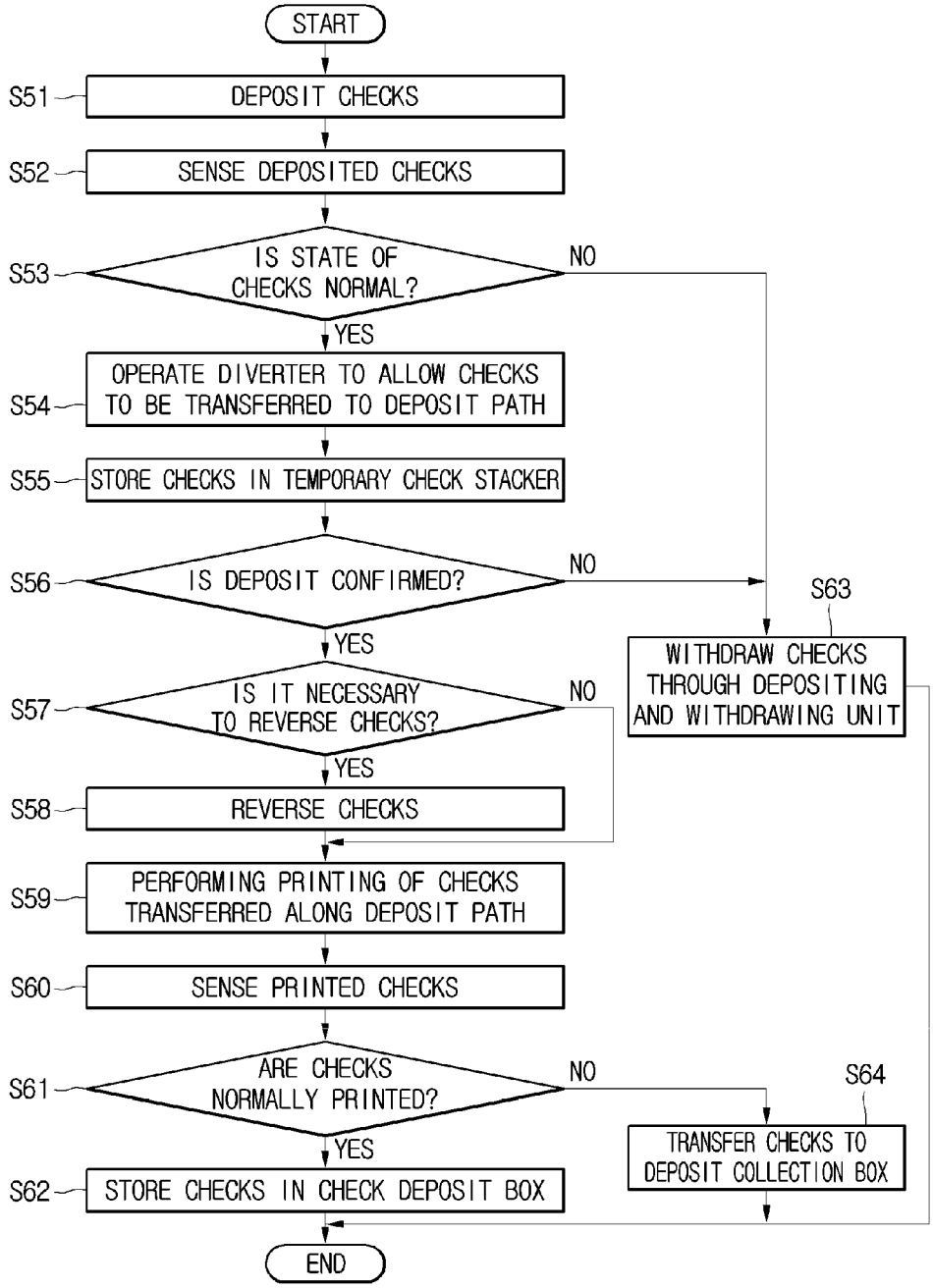
FIG. 10 is a flowchart illustrating a process of depositing checks according to the third embodiment of the present invention.
Figure 11:
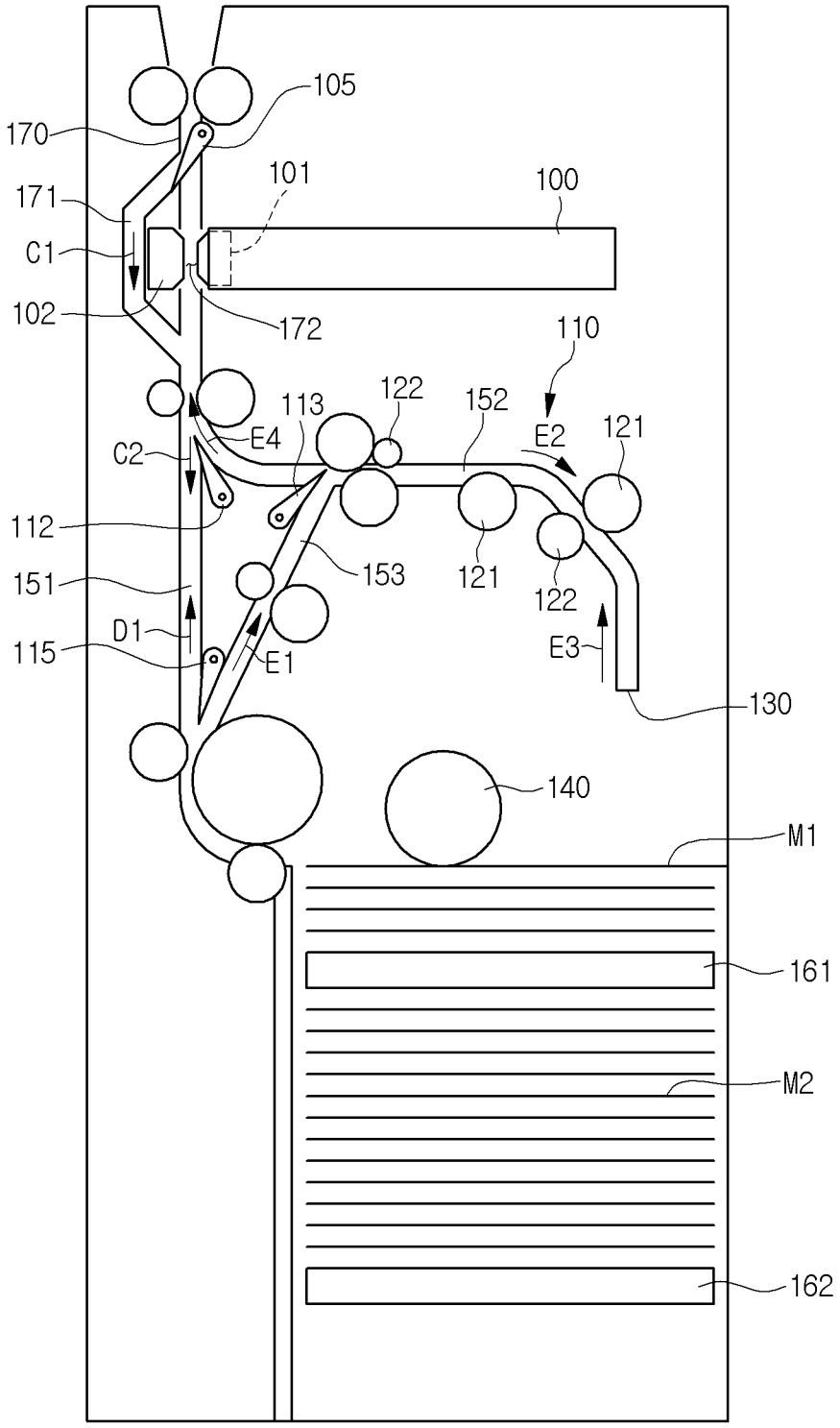
FIG. 11 is a diagram illustrating a transfer path of checks in the check storage box when depositing the checks according to the third embodiment of the present invention.

FIG. 10 is a flowchart illustrating a process of depositing checks according to the third embodiment of the present invention, and FIG. 11 is a diagram illustrating a transfer path of checks in the check storage box 44 when depositing the checks according to the third embodiment of the present invention.

Referring to FIGS. 9 to 11, checks are deposited for deposit of the checks (S51). Hereinafter, as an example, it will be described that the checks are deposited laterally. As described above, the checks may be deposited as a bundle comprising sheets and may be deposited together with banknotes. Otherwise, only banknotes may be deposited as a bundle comprising sheets. In FIG. 11, as an example, the process of depositing checks will be described. Since a process of depositing banknotes may be similar to general well-known processes, a detailed description thereof will be omitted.

After being deposited, the checks are transferred laterally to the discrimination unit 20. The discrimination unit 20 senses a state of the deposited checks (S52).

After that, the discrimination unit 20 or a control unit (not shown) determines whether the deposited checks are normal (S53). When the deposited checks are normal, the checks M1 deposited into the check storage box 44 are transferred along the deposit path 171 (an arrow C1). That is, the diverter 105 operates to allow the checks M1 to be transferred along the deposit path 171 (S54). Also, the checks transferred along the deposit path 171 are transferred along the main path 151 and then are stacked in the temporary check stacker (S55, an arrow C2).

On the contrary, when the deposited checks are abnormal, the checks are withdrawn through the medium depositing and withdrawing unit 13 (S63).

After that, it is determined whether a customer inputs a deposit confirmation command for the checks (S56). In operation S56, when a deposit cancellation command is inputted, the checks M1 temporarily stacked in the check storage box 44 are withdrawn through the medium depositing and withdrawing unit 13 (S63).

In operation S56, when it is determined that the deposit confirmation command for the checks is inputted, it is determined whether it is necessary to reverse the checks (S57). Herein, since the state of the checks is determined by the discrimination unit 20 before temporarily stacking the checks, the determined state of the checks is stored in a memory (not shown). When the deposit confirmation command for the checks is inputted, the state of the checks stored in the memory is recognized, thereby determining whether it is necessary to reverse the checks. When it is necessary to reverse the checks, the checks are reversed by the reversal unit 110 while being withdrawn. In detail, the checks picked up by the pickup roller 140 are transferred to the second transfer path 153 by the third diverter 115 (an arrow E1). After that, the checks on the second transfer path 153 are transferred to the first transfer path 152 by the second diverter 113. The checks transferred to the first transfer path 152 are transferred by unidirectional rotations of the driving roller 121 and the pinch roller 122 and mounted on the supporting unit 130 (an arrow E2). After that, the checks on the supporting unit 130 are transferred along the first transfer path 152 and reversed by rotations of the driving roller 121 and the pinch roller 122 in an opposite direction (arrows E3 and E4). The checks M1 completely reversed are transferred to the main path 151 and then are transferred to the withdrawal path 172 and printed by the printing head 101 (S59).

In detail, the checks M1 temporarily stacked in the check storage box 44 stop while being transferred to between the printing head 101 and the transfer guide 102. After that, while the checks M1 are stopping, the printing head 101 may perform printing while being moved by a head moving unit (not shown) in a longitudinal direction of the checks M1.

When the printing is finished, the checks M1 are allowed to pass through the discrimination unit 20. The discrimination unit 20 senses a state of the printed checks (S60). Also, the discrimination unit 20 or the control unit determines whether the checks are normally printed (S61). When it is determined that the printing of the checks is normally performed, the checks M1 are stored in the check deposit box 54 (S62). On the contrary, when it is determined that the checks are not normally printed, the checks M1 are transferred to a deposit collection box, that is, the first collection box 50 (S64).

Since a process of withdrawing checks according to the third embodiment is identical to the process of withdrawing checks according to the first embodiment, a detailed description will be omitted.

According to the third embodiment, since a deposit path and a withdrawal path are distinguished and checks deposited into a check storage box pass through the deposit path and are stacked on a temporary check stacker, a speed of stacking checks increases. Also, the checks deposited into the check storage box are stacked in the temporary check stacker without passing through a printing apparatus, thereby preventing the checks from being caught by the printing apparatus while the checks are being transferred.

In the above, checks are stacked on a temporary check stacker and the checks are reversed by a reversal unit after confirming deposit. Differently, when it is necessary to reverse checks, as the second embodiment, the checks may be reversed before being mounted on the temporary check stacker and the checks may be stacked in the temporary check stacker.

In the above example, a deposit path and a withdrawal path of checks while printing the checks have been described. Differently, when it is necessary to print other medium in addition to the checks, the deposit path and the withdrawal path may be distinguished.

That is, the deposit path and the withdrawal path described in the third embodiment may be applied to various storage boxes such as a banknote storage box, a collection box, etc., in addition to a check storage box.

Figure 12:
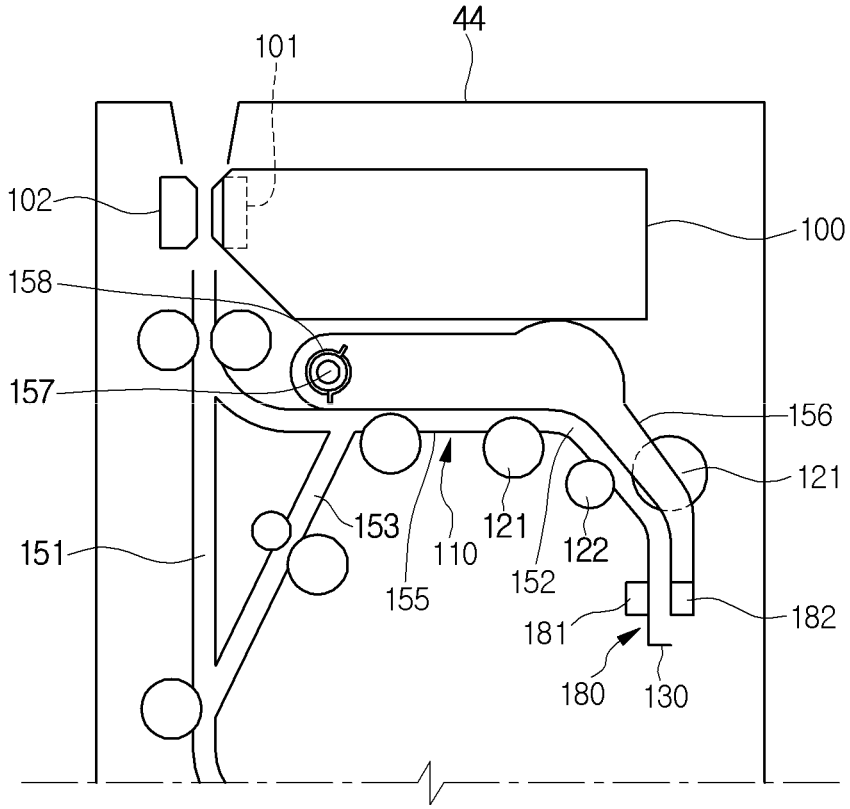
FIGS. 12 and 13 are schematic diagrams of a check storage box according to a fourth embodiment of the present invention.
Figure 13:
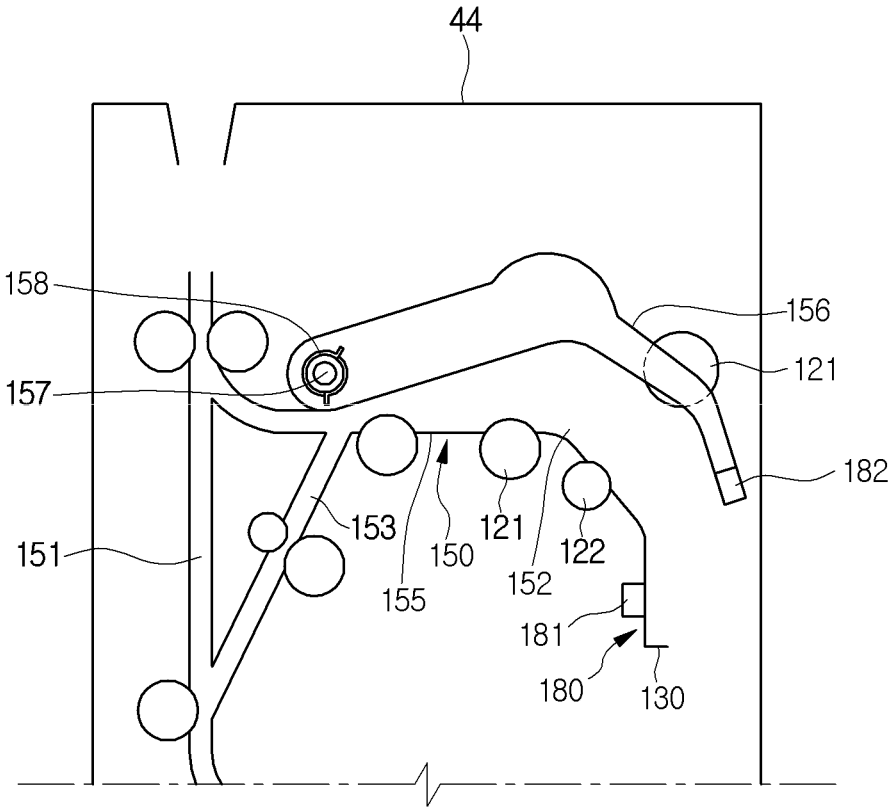

FIGS. 12 and 13 are schematic diagrams of an example of the check storage box 44 according to a fourth embodiment of the present invention. FIG. 12 is a diagram illustrating a state, in which the printing apparatus 100 is mounted on the check storage box 44. FIG. 13 is a diagram illustrating a state, in which the printing apparatus 100 is separate from the check storage box 44.

The fourth embodiment is identical to one or more of the first to third embodiments except the printing apparatus 100 capable of being mounted on the reversal unit 110. Accordingly, hereinafter, only particular parts of the fourth embodiment will be described.

Also, in FIGS. 12 and 13, a deposit path, a withdrawal path, and a depositing and withdrawing path described in the third embodiment are not shown. However, the deposit path, the withdrawal path, and the depositing and withdrawing path may well be provided in the check storage box 44 of the fourth embodiment.

Referring to FIG. 12, the check storage box 44 according to the fourth embodiment may comprise the printing apparatus 100 for printing of checks, the main path 151 for transferring the checks, and the reversal unit 110 for reversing the checks.

The main path 151 connects the printing apparatus 100 and the temporary check stacker.

The printing apparatus 100 may be mounted on the check storage box 44 to be separable. That is, the printing head 101 and the transfer guide 102 may be separated together from the check storage box 44. Differently, as described in the first embodiment, the printing head 102 may be separated from the check storage box 44 while the transfer guide 102 is being located in the check storage box 44.

To allow the printing apparatus 100 to be mounted on the check storage box 44 to be separable, the check storage box 44 may comprise a door (not shown) capable of opening and closing an inner space of the check storage box 44.

The reversal unit 110 may comprise the first transfer path 152 for diverging from the main path 151 and the second transfer path 153 for diverging from the first transfer path 152 to connect the first transfer path 152 and the main transfer path 151.

The reversal unit 110 may comprise a first transfer guide 155 for forming the first transfer path 152 and a second transfer guide 156.

The first transfer guide 155 may be fixed to a frame (not shown) fixed to the inside of the check storage box 44. The second transfer guide 156 may be connected to one of the frame and the first transfer guide 155 by a hinge axis 157 to be rotatable.

In a state as shown in FIG. 12, when the printing apparatus 100 is separated from the check storage box 44, the second transfer guide 156, as shown in FIG. 13, may rotate counterclockwise on the hinge axis 157.

Also, in a state as shown in FIG. 13, when the printing apparatus 100 is mounted on the check storage box 44, the second transfer guide 156 rotates clockwise on the hinge axis 157 to be in the state of FIG. 12.

That is, the printing apparatus 100 may be mounted on a top of the second transfer guide 156 and may pressurize the second transfer guide 156. Also, the hinge axis 157 may be connected to an elastic member 158. The elastic member 158 provides the second transfer guide 156 with an elastic force to allow the second transfer guide 156 to rotate on the hinge axis 157 counterclockwise, that is, in a direction of lifting the second transfer guide 156. That is, the elastic member 158 provides the second transfer guide 156 with the elastic force to allow the second transfer guide 156 to rotate in a direction not to form the first transfer path 152.

As in the present embodiment, when the printing apparatus 100 is separated from the check storage box 44, the elastic force of the elastic member 158 is applied to the second transfer guide 156, thereby lifting the second transfer guide 156 as shown in FIG. 13. Accordingly, when a jam of a medium occurs on one of the first transfer path 152 and the second transfer path 153, the printing apparatus 100 is separated from the check storage box 44, thereby easily removing the jam of the medium. That is, a worker may easily access the respective transfer paths 152 and 153.

As another example, when the respective transfer guides 155 and 156 are provided with a roller for transferring medium and the printing apparatus 100 is mounted, the roller of the second transfer guide 156 pressurizes the roller of the first transfer guide 155. Herein, when the printing apparatus 100 is separated, due to a repulsive force between the rollers, the second transfer guide 156 may be separated from the first transfer guide 155.

The first transfer path 152 may comprise the supporting unit 130 for supporting transferred checks on an end thereof. The supporting unit 130, as an example, may be formed by the first transfer guide 155. The supporting unit 130 may well be formed on the second transfer guide 156.

Also, the reversal unit 110 may further comprise a sensing unit 180 for sensing medium on the first transfer path 152.

In detail, the sensing unit 180 may comprise a sensor part 181 provided on the first transfer guide 155 and a prism 182 provided on the second transfer guide 156.

Also, the sensor part 181 may further comprise a light emitting sensor and a light receiving sensor. Accordingly, light emitted from the light emitting sensor may pass through the prism 182 and may be incident on the light receiving sensor. In the present embodiment, when the light of the light emitting sensor is incident on the light receiving sensor, it may be determined that a medium is not sensed. When the light of the light emitting sensor is not incident on the light receiving sensor, it may be determined that a medium is sensed.

In the present embodiment, since the prism 182 is provided on the second transfer guide 156, it is necessary to mount the printing apparatus 100 on the check storage box 44 to align the prism 182 with the sensor part 181. Accordingly, when the printing apparatus 100 is separated from the check storage box 44, the second transfer guide 156 rotates in such a way that the prism 182 is not aligned with the sensor part 181.

The prism 182 is provided on the second transfer guide 156 as described above, thereby checking whether the printing apparatus 100 is mounted, by using the sensing unit 180 in the present embodiment.

That is, when the printing apparatus 100 is not mounted on the check storage box 44, since the prism 182 is not aligned with the sensor part 181, the light emitted by the light emitting sensor is not receivable by the light receiving sensor. Accordingly, when the light receiving sensor does not receive the light, it may be determined that the printing apparatus 100 is not mounted on the check storage box 44.

Also, when the light receiving sensor receives the light, it may be determined that the printing apparatus 100 is mounted. After determining that the printing apparatus 100 is mounted on the check storage box 44, the sensing unit 180 is used to sense whether a medium exists on the first transfer path 152.

Accordingly, according to the present embodiment, using a single sensing unit 180, it is possible to sense not only a medium but also whether the printing apparatus 100 is mounted, thereby simplifying the configuration of the check storage box 44 and reducing manufacturing costs.

It may be possible to sense whether the printing apparatus 100 is mounted, by additionally comprising a sensor using the same theory of the sensing unit 180 or another theory.

In the above embodiment, the sensor part 181 is provided on the first transfer guide 155 and the prism 182 is provided on the second transfer guide 156. Differently, a light emitting sensor may be provided on one of the first transfer guide 155 and the second transfer guide 156 and a light receiving sensor may be provided the other of the first transfer guide 155 and the second transfer guide 156. As another example, a prism may be provided on the first transfer guide 155 and a sensor part may be provided on the second transfer guide.

In the fourth embodiment, it has been described to sense whether a printing apparatus is mounted. Differently, it may be possible to sense whether other components separable from a medium storage box are mounted.

Also, in the fourth embodiment, a check storage box has been described as an example. However, the inventive concept may be applied to any configuration capable of storing medium such as a banknote storage box, a collection box, etc.

Also, the inventive concept may be applied as it is to a transfer guide for forming a transfer path for medium inside the financial device 1 in addition to a medium storage box.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

The invention claimed is:

1. A medium storage box comprising:

a medium depositing and withdrawing unit through which medium is deposited or withdrawn;

a temporarily medium stacker for temporarily stacking the medium deposited through the medium depositing and withdrawing unit;

a medium storage unit for storing medium for withdrawal;

a printing apparatus for printing one of the deposited medium and the medium for withdrawal; and a reversal unit for reversing the deposited medium when it is necessary to reverse the deposited medium.

2. The medium storage box of claim 1, further comprising:

a deposit path formed to be connected from the medium depositing and withdrawing unit to the temporary medium stacker in a way of detouring the printing apparatus; and a withdrawal path formed to be connected from the temporary medium stacker to the medium depositing and withdrawing unit in a way of passing through the printing apparatus.

3. The medium storage box of claim 2, wherein the medium deposited through the medium depositing and withdrawing unit is transferred along the deposited path and stacked in the temporary medium stacker, and wherein the medium stacked in the temporary medium stacker is transferred along the withdrawal path and printed by the printing apparatus.

4. The medium storage box of claim 2, wherein the medium for withdrawal stored in the medium storage unit is transferred along the deposit path and printed by the printing apparatus.

5. The medium storage box of claim 2, further comprising:

a depositing and withdrawing path for connecting the deposit path and the withdrawal path to the medium depositing and withdrawing unit; and a diverter for adjusting a transfer direction of medium to allow the medium on the depositing and withdrawing path to be transferred to the deposit path.

6. The medium storage box of claim 1, wherein the reversal unit is disposed on a path between the printing apparatus and the temporary medium stacker.

7. The medium storage box of claim 1, wherein when it is necessary to reverse the deposited medium, the deposited medium is reversed by the reversal unit and then stacked in the temporary medium stacker.

8. The medium storage box of claim 1, wherein the deposited medium is stacked in the temporary medium stacker without reversal, and when it is necessary to reverse the deposited medium, the medium stacked in the temporary medium stacker is reversed by the reversal unit and printed by the printing apparatus.

9. The medium storage box of claim 1, further comprising a main path for connecting the printing apparatus and the temporary medium stacker, wherein the reversal unit comprises a first transfer path diverged from the main path and a second transfer path for connecting the first transfer path and the main path.

10. The medium storage box of claim 9, wherein the reversal unit further comprises:

a first diverter provided in a connection portion between the main path and the first transfer path;

a second diverter provided in a connection portion between the first transfer path and the second transfer path; and a third diverter provided in a connection portion between the main path and the second transfer path.

11. The medium storage box of claim 1, wherein the reversal unit further comprises:

a first transfer guide for forming a transfer path of the medium; and a second transfer guide for forming the transfer path of the medium together with the first transfer guide and movable with respect to the first transfer guide, and wherein the printing apparatus is mounted on the second transfer guide.

12. The medium storage box of claim 11, further comprising a sensing unit for sensing whether the printing apparatus is mounted.

13. The medium storage box of claim 12, wherein the sensing unit comprises a sensor part provided on one of the first transfer guide and the second transfer guide and a prism provided on the other of the first transfer guide and the second transfer guide.

14. The medium storage box of claim 12, wherein the sensing unit comprises a light emitting sensor provided on one of the first transfer guide and the second transfer guide and a light receiving sensor provided on the other of the first transfer guide and the second transfer guide.

15. The medium storage box of claim 12, wherein the second transfer guide is rotatable on a hinge axis, and wherein the reversal unit further comprises an elastic member for providing the second transfer guide with a rotational force for allowing the second transfer guide to rotate on the hinge axis not to form the transfer path.

16. The medium storage box of claim 12, wherein the first transfer guide and the second transfer guide are provided with a roller, respectively, wherein when the printing apparatus is mounted, the roller of the second transfer guide pressurizes the roller of the first transfer guide, and wherein when the printing apparatus is separated, the second transfer guide is separated from the first transfer guide due to a repulsive force between the rollers.

17. A financial device comprising:

a depositing and withdrawing unit for allowing medium to be deposited or withdrawn;

a temporary medium stacker for temporarily stacking the medium deposited through the depositing and withdrawing unit;

a reversal unit for reversing the deposited medium when it is necessary to reverse the deposited medium;

a medium storage space for storing medium for withdrawal, a printing apparatus for printing the deposited medium and the medium for withdrawal; and a medium deposit space for storing the printed medium for deposit, wherein the deposited medium is reversed by the reversal unit before being printed by the printing apparatus.

18. The financial device of claim 17, further comprising a medium storage box in which the medium storage space is disposed, wherein the temporary medium stacker, the printing apparatus, and the reversal unit are located inside the medium storage box.

19. The financial device of claim 17, further comprising:

a deposit path for allowing the deposited medium to be transferred to the temporary medium stacker detouring the printing apparatus; and a withdrawal path for allowing the medium for being printed to be transferred from the temporary medium stacker passing through the printing apparatus.

20. The financial device of claim 17, wherein the reversal unit further comprises:

a first transfer guide for forming a transfer path of the medium; and a second transfer guide for forming the transfer path of the medium together with the first transfer guide and movable with respect to the first transfer guide, and wherein the printing apparatus is mounted on the second transfer guide.

21. The financial device of claim 20, wherein the second transfer guide is rotatable on a hinge axis, and wherein the reversal unit further comprises an elastic member for providing the second transfer guide with a rotational force for allowing the second transfer guide to rotate on the hinge axis not to form the transfer path.

22. A financial device, comprising:

a medium depositing and withdrawing unit through which banknotes and checks are deposited or withdrawn;

a discrimination unit to discriminate states of the banknotes and checks;

a temporary banknote stacker for temporarily stacking the banknotes deposited through the medium depositing and withdrawing unit;

a temporary check stacker for temporarily stacking the checks deposited through the medium depositing and withdrawing unit;

a banknote storage box for storing the deposited banknotes and the banknotes for withdrawal; and a check storage box for storing checks for withdrawal and comprising a printing apparatus, wherein the printing apparatus prints both the deposited checks and the checks for withdrawal.

23. The financial device of claim 22, further comprising a check deposit box for storing the deposited checks printed by the printing apparatus.

24. The financial device of claim 23, wherein the deposited checks printed by the printing apparatus pass through the discrimination unit.

25. The financial device of claim 24, wherein the discrimination unit determines whether the deposited checks are normally printed, when it is determined that the printing of the deposited checks is normally performed, the deposited checks are stored in the check deposit box; and when it is determined that the deposited checks arc not normally printed, the deposited checks are transferred to a deposit collection box.

26. The financial device of claim 22, wherein the deposited checks are reversed before being printed by the printing apparatus.

* * * * *